US011351788B2

(12) United States Patent
Miyasaka et al.

(10) Patent No.: US 11,351,788 B2
(45) Date of Patent: Jun. 7, 2022

(54) LIQUID ABSORBER AND IMAGE FORMING APPARATUS

(71) Applicant: SEIKO EPSON CORPORATION, Tokyo (JP)

(72) Inventors: Yoichi Miyasaka, Nagano (JP); Nobutaka Urano, Nagano (JP); Kaneo Yoda, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/079,562

(22) Filed: Oct. 26, 2020

(65) Prior Publication Data

US 2021/0122163 A1 Apr. 29, 2021

(30) Foreign Application Priority Data

Oct. 28, 2019 (JP) ..... JP2019-195077

(51) Int. Cl.

| | |
|---|---|
| ***B41J 2/17*** | (2006.01) |
| ***B41J 2/185*** | (2006.01) |
| *B41J 2/18* | (2006.01) |

(52) U.S. Cl.

CPC ..... *B41J 2/1721* (2013.01); *B41J 2/1714* (2013.01); *B41J 2/185* (2013.01); *B41J 2/18* (2013.01); *B41J 2002/1728* (2013.01); *B41J 2002/1735* (2013.01); *B41J 2002/1856* (2013.01)

(58) Field of Classification Search

CPC .... B41J 2/16523; B41J 2/1714; B41J 2/1721; B41J 2002/1728; B41J 2002/1735; B41J 2002/1742; B41J 2002/1856; B41J 2/185; B41J 2/18; B41J 2/01

See application file for complete search history.

(56) References Cited

U.S. PATENT DOCUMENTS

| | | | | |
|---|---|---|---|---|
| 6,274,522 | B1 | 8/2001 | Sameshima et al. | |
| 2002/0042237 | A1 | 4/2002 | Sameshima et al. | |
| 2014/0184692 | A1 * | 7/2014 | Takano | B41J 2/16517 347/31 |
| 2017/0119226 | A1 | 5/2017 | Nakayama et al. | |

FOREIGN PATENT DOCUMENTS

| | | | |
|---|---|---|---|
| CN | 106661787 | A | 5/2017 |
| JP | H09-158024 | A | 6/1997 |
| JP | 2019-171597 | A | 10/2019 |
| WO | 2019/187444 | A1 | 10/2019 |

* cited by examiner

*Primary Examiner* — Kristal Feggins

(74) *Attorney, Agent, or Firm* — Global IP Counselors, LLP

(57) ABSTRACT

A liquid absorber includes a container that has an opening and that recovers liquid and a first absorbing unit that is constituted by an aggregate of porous absorbing body blocks and that is housed in the container such that a gap exists between the porous absorbing body blocks. The porous absorbing body blocks have a density of 0.05 [g/cm$^3$] or more and 0.50 [g/cm$^3$] or less.

8 Claims, 7 Drawing Sheets

LIQUID ABSORBER AND IMAGE FORMING APPARATUS

The present application is based on, and claims priority from JP Application Serial Number 2019-195077, filed Oct. 28, 2019, the disclosure of which is hereby incorporated by reference herein in its entirety.

BACKGROUND

1. Technical Field

The present disclosure relates to a liquid absorber and an image forming apparatus.

2. Related Art

In ink jet printers, on occasions such as when charging ink after replacing an ink cartridge and when performing head cleaning to prevent a deterioration in print quality caused by ink clogging, waste ink is produced. To suppress such waste ink from adhering to a mechanism inside a printer, an ink jet printer includes a liquid absorber to absorb waste ink.

For example, JP-A-9-158024 discloses a liquid absorbing body containing a natural cellulose fiber or a synthetic fiber, a heat fusible material, and a thickening material. Such a liquid absorbing body is produced by mixing and defibrating a natural cellulose fiber or a synthetic fiber, a heat fusible material, and a thickening material in air to form a mat, heating the obtained mat to a temperature equal to or higher than the melting point of the heat fusible material, and thereafter compressing the heated mat by a press roll.

The use of the thickening material enables the liquid absorbing body to have excellent swelling properties. Accordingly, the volume hardly increases, even after liquid has been absorbed. This enables a liquid absorbing body having a volume that is substantially equal to the space available in the liquid absorbing body to be realized with little consideration given to a volume increase after liquid absorption.

During use, a liquid absorbing body is usually housed in a container capable of housing liquid. The liquid absorbing body described in JP-A-9-158024 is produced by cutting the mat in such a manner as to achieve a volume that is equivalent to the volume of the container, and stacking the cut mat.

However, in this configuration, the cut pattern of the mat needs to be changed for each container. This raises a problem in that the production cost of a liquid absorbing body increases. Furthermore, since the mat is dense, a portion that has swollen due to liquid absorption by the thickening material is inhibited from further absorbing liquid. This raises another problem in that only a part of the entire mat can absorb liquid. As a result, liquid permeability decreases.

SUMMARY

According to an aspect of the present disclosure, there is provided a liquid absorber including a container that has an opening and that recovers liquid and a first absorbing unit that is constituted by an aggregate of porous absorbing body blocks and that is housed in the container such that a gap exists between the porous absorbing body blocks. In the liquid absorber, the porous absorbing body blocks have a density of 0.05 [g/cm$^3$] or more and 0.50 [g/cm$^3$] or less.

According to another aspect of the present disclosure, there is provided an image forming apparatus including the liquid absorber according to the above aspect of the present disclosure.

DESCRIPTION OF EXEMPLARY EMBODIMENTS

Hereinafter, liquid absorbers and image forming apparatuses according to embodiments of the present disclosure will be described in detail with reference to the attached drawings.

1. First Embodiment

First, a liquid absorber and an image forming apparatus according to a first embodiment will be described.

1.1. Image Forming Apparatus

Figure 1:
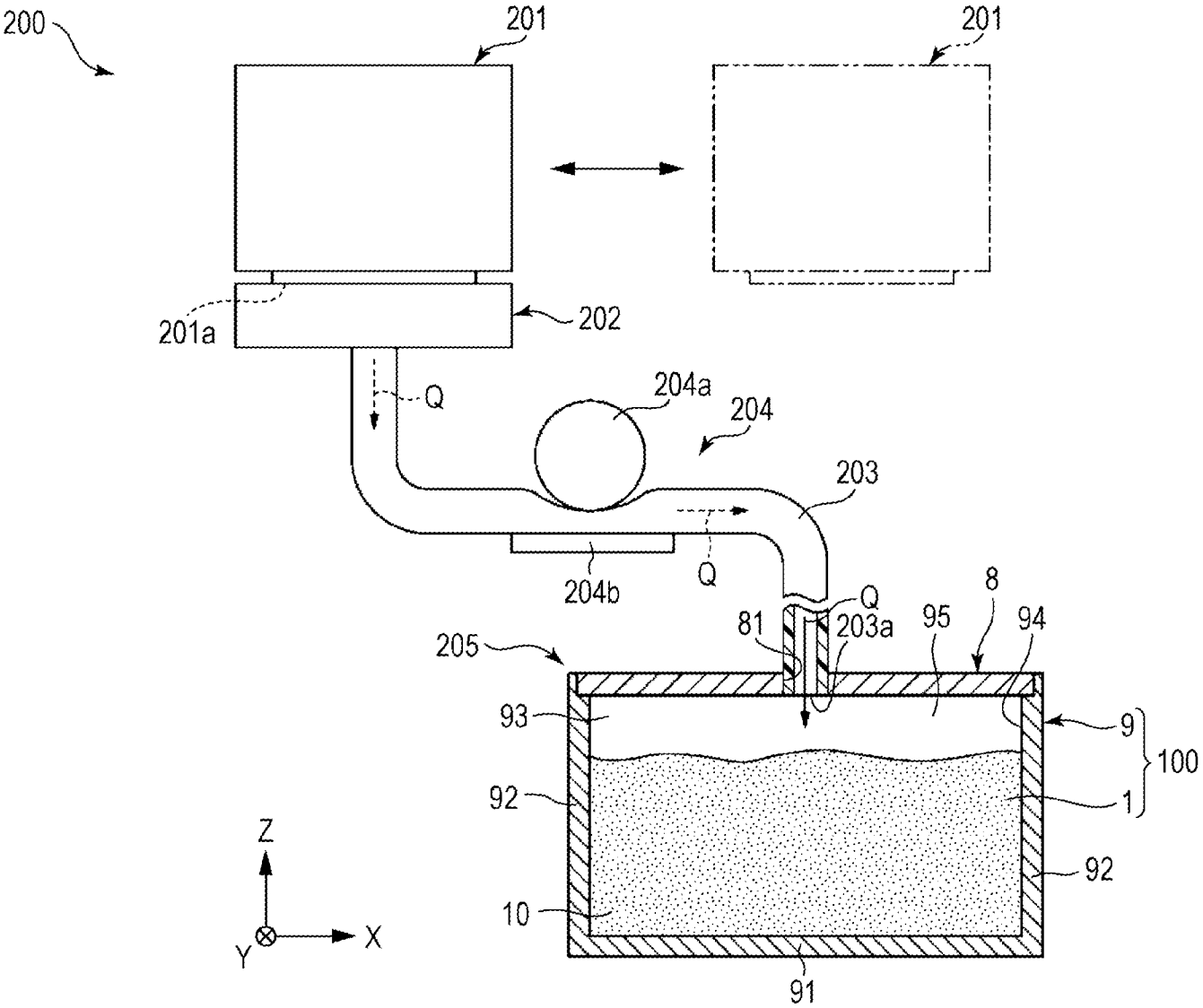
FIG. 1 is a partial vertical sectional view illustrating a liquid drop discharger according to a first embodiment and a liquid absorber according to the embodiment.

FIG. 1 is a partial vertical sectional view illustrating a liquid drop discharger according to a first embodiment and a liquid absorber according to the embodiment. In the drawings of the present application, three mutually orthogonal axes are defined as the X-axis, the Y-axis, and the Z-axis. Each of the axes is indicated by an arrow. The tip side of the arrow denotes a plus side of the axis, and the base side denotes a minus side of the axis. Also, "upper" denotes the plus side of the Z-axis, and "lower" denotes the minus side of the Z-axis.

An image forming apparatus 200 illustrated in FIG. 1 is, for example, an ink jet-type color printer. This image forming apparatus 200 includes a liquid absorber 100 that recovers a waste liquid of an ink Q, which is an example of a liquid.

The image forming apparatus 200 includes an ink discharge head 201 that discharges the ink Q, a capping unit 202 that prevents clogging of nozzles 201*a* of the ink discharge head 201, a tube 203 that couples the capping unit 202 and the liquid absorber 100, a roller pump 204 that delivers the ink Q from the capping unit 202, and a recovery unit 205.

The ink discharge head 201 has a plurality of nozzles 201*a* that downwardly discharge the ink Q. The ink discharge head 201 can discharge the ink Q while moving relative to a recording medium such as paper for printing.

While the ink discharge head 201 is in a standby position, the capping unit 202 simultaneously sucks the nozzles 201*a* by actuating the roller pump 204. This prevents clogging of the nozzles 201*a*.

The tube 203 is a pipe channel that transfers the ink Q sucked through the capping unit 202 to the liquid absorber 100. This tube 203 is flexible.

The roller pump 204 is disposed at a certain position along the tube 203. The roller pump 204 includes a roller unit 204*a* and a holding unit 204*b* that holds the tube 203 between the holding unit 204*b* and the roller unit 204*a* at the certain position of the tube 203. The rotation of the roller unit 204*a* provides a suction force to the capping unit 202 via the tube 203. When the rotation of the roller unit 204*a* continues, the ink Q adhering to the nozzles 201*a* can be delivered to the recovery unit 205.

The recovery unit 205 includes the liquid absorber 100 having a first absorbing unit 10. The ink Q is delivered to the liquid absorber 100 and absorbed as waste liquid by the first absorbing unit 10 in the liquid absorber 100.

Although the waste liquid of the ink Q is absorbed by the liquid absorber 100 in the present embodiment, the liquid to be absorbed by the liquid absorber 100 is not limited to the waste liquid of the ink Q, and other various liquids may be absorbed.

1.2. Liquid Absorber

The liquid absorber 100 illustrated in FIG. 1 includes the first absorbing unit 10, a container 9 that houses the first absorbing unit 10, and a lid body 8 attached to the container 9.

The liquid absorber 100 is removably attached to the image forming apparatus 200. In the attached state, the liquid absorber 100 is used to absorb the waste liquid of the ink Q as described above. When the amount of the ink Q absorbed in the liquid absorber 100 reaches its limit, this liquid absorber 100 can be replaced with a new unused liquid absorber 100.

1.2.1. Container

The container 9 houses the first absorbing unit 10. The container 9 has a box shape that includes a bottom portion 91 having a substantially rectangular shape in plan view and four side wall portions 92 which stand upright from the edges of the bottom portion 91. The first absorbing unit 10 is housed in a housing space 93 surrounded by the bottom portion 91 and the four side wall portions 92.

The container 9 is not limited to a container including the bottom portion 91 having a substantially rectangular shape in plan view. Another example of the container 9 is a container including the bottom portion 91 that has a circular shape in plan view and that is entirely cylindrical or a container including the bottom portion 91 that has a polygonal shape or the like in plan view.

Although the container 9 may be flexible, it is preferably rigid. The rigid container 9 refers to a container having rigidity such that the volume does not change by 10% or more in response to internal or external pressure. Such a container 9 can maintain its shape, even when a force attributable to expansion is applied from the inside after the first absorbing unit 10 has absorbed the ink Q. This stabilizes a disposition state of the container 9 in the image forming apparatus 200.

It is noted that the constituent material of the container 9 is not particularly limited, as long as it is impermeable to the ink Q. Examples thereof include various resin materials such as cyclic polyolefins and polycarbonates and various metal materials such as aluminum and stainless steel.

Also, although the container 9 has internal visibility when it is transparent or translucent, it may also be opaque.

The lid body 8 has a plate-like shape and is fitted to an upper opening 94 of the container 9. Due to this fit, the upper opening 94 can be sealed in a liquid-tight manner. This can prevent, for example, the ink Q from externally splattering even when the ink Q strikes the first absorbing unit 10 and rebounds. The lid body 8 may be integrally formed with the container 9 or may be omitted.

In the center of the lid body 8, a coupling port 81 to be coupled with the tube 203 is disposed. The coupling port 81 is a through hole which extends through the lid body 8 in the thickness direction. The downstream end of the tube 203 is inserted into this coupling port 81. Also, a discharge port 203*a* of the tube 203 faces downward (the minus side of the Z-axis). The waste liquid of the ink Q discharged from the discharge port 203*a* drips immediately therebelow.

The orientation of the discharge port 203*a* illustrated in FIG. 1 is not limited to the above configuration. For example, the coupling port 81 to be coupled with the tube 203 may be disposed on the side wall portion 92 instead of on the lid body 8. In such a case, the discharge port 203*a* may face, for example, a direction parallel to the horizontal plane, that is, the plus or minus side of the X-axis or the plus or minus side of the Y-axis. Also, the discharge port 203*a* may face a direction inclined with respect to the X-axis, the Y-axis, or the Z-axis.

Furthermore, radial ribs or grooves, for example, may be formed around the coupling port 81 on the lower surface of the lid body 8. The ribs or grooves function so as to, for example, control the direction of the flow of the ink Q in the container 9.

The lid body 8 may have the absorptive property of absorbing the ink Q or the repellent property of repelling the ink Q.

1.1.2. First Absorbing Unit

Figure 2:
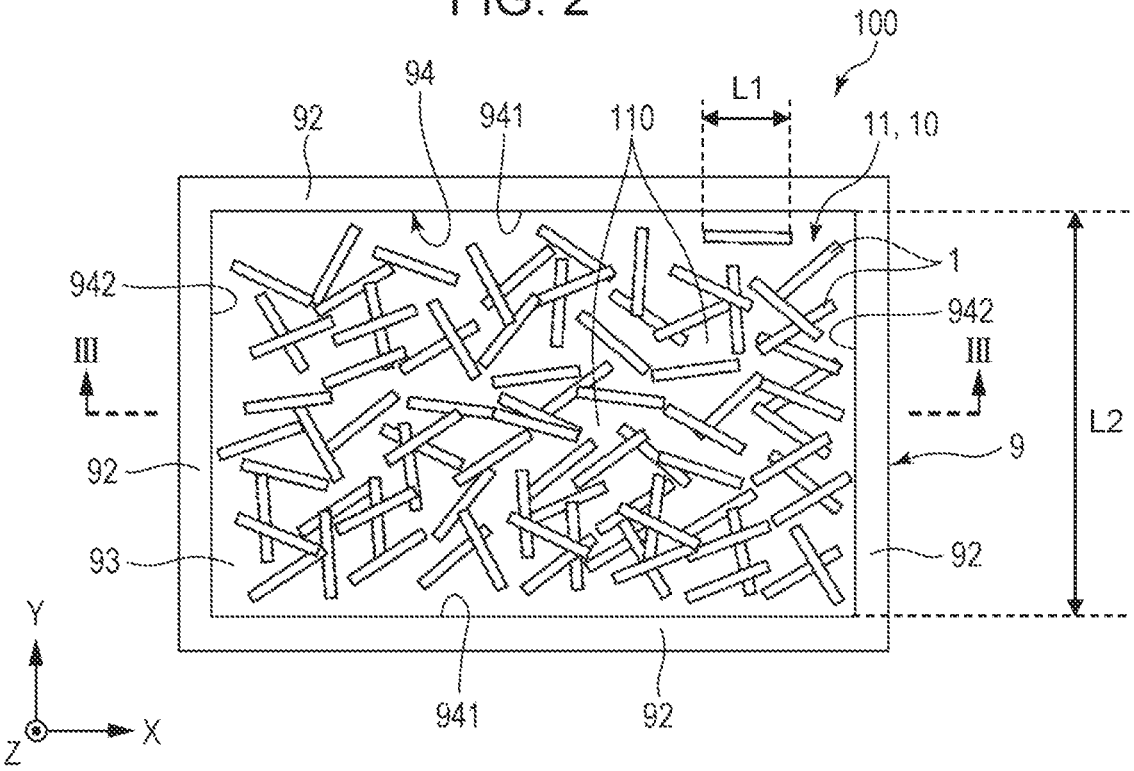
FIG. 2 is a plan view illustrating the liquid absorber of FIG. 1 in detail.
Figure 3:
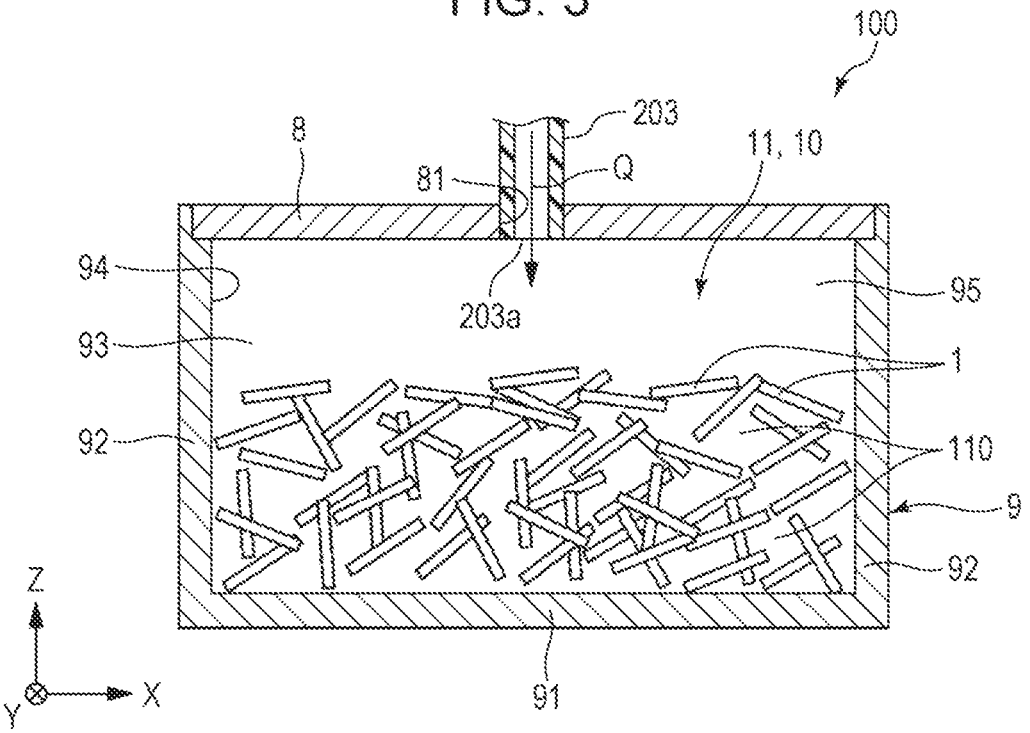
FIG. 3 is a sectional view taken along line III-III of FIG. 2.
Figure 4:
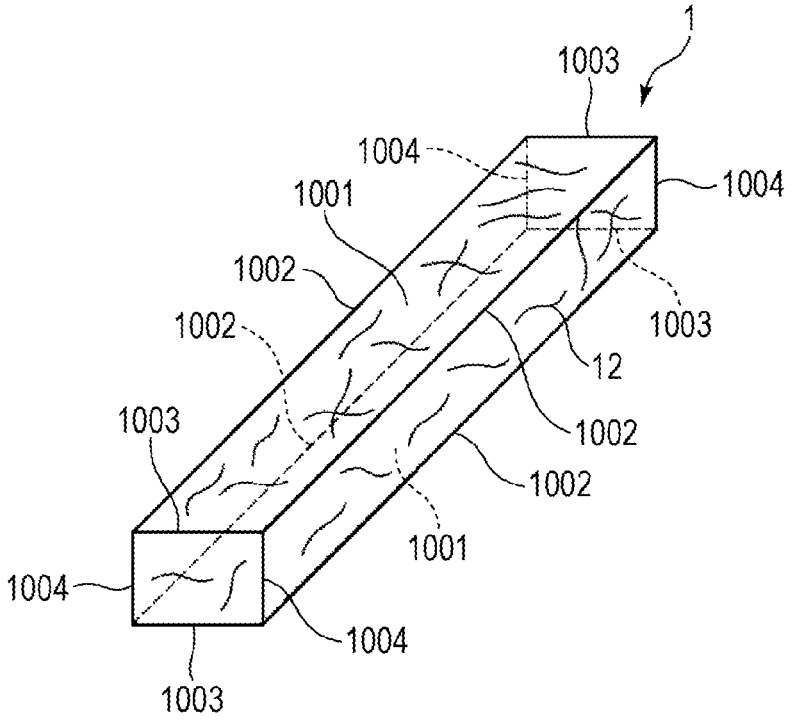
FIG. 4 is a perspective view illustrating an example of a porous absorbing body block contained in a first absorbing unit of FIG. 2 and FIG. 3.

FIG. 2 is a plan view illustrating the liquid absorber 100 of FIG. 1 in detail. FIG. 3 is a sectional view taken along line III-III of FIG. 2. FIG. 4 is a perspective view illustrating an example of a porous absorbing body block 1 contained in the first absorbing unit 10 of FIG. 2 and FIG. 3.

The first absorbing unit 10 housed in the container 9 is constituted by a block aggregate 11 illustrated in FIG. 2 and FIG. 3. The block aggregate 11 is an aggregate of a plurality of porous absorbing body blocks 1. The number of porous absorbing body blocks 1 contained in the container 9 is not particularly limited and is appropriately determined depending on various conditions such as the application of the liquid absorber 100. The maximum amount of the ink Q absorbed can be adjusted depending on the amount of the housed porous absorbing body blocks 1.

Also, when V1 is the volume of the housing space 93 of the container 9, and V2 is the total volume of the porous absorbing body blocks 1 before the ink Q is absorbed, a ratio V2/V1 of V2 to V1 is preferably 0.1 or more and 0.7 or less, and more preferably 0.2 or more and 0.7 or less. Accordingly, a void 95 is generated in the container 9. The void 95 serves as a buffer when the porous absorbing body blocks 1 sometimes expand after absorbing the ink Q. Therefore, the porous absorbing body blocks 1 can achieve sufficient expansion and sufficiently absorb the ink Q.

The porous absorbing body blocks 1 have a block-like shape, and the block aggregate 11 as an aggregate of the porous absorbing body blocks 1 is housed in the container 9. Therefore, a gap 110 exists between the porous absorbing body blocks 1, and the block aggregate 11 easily changes into any shape. Thus, regardless of the shape of the container 9, the housing space 93 of the container 9 can be filled with the first absorbing unit 10. Here, the block-like shape refers to a shape having a shortest edge with a length of 1.0 mm or more and a longest edge that can be housed in the container 9 when elongated.

Furthermore, the permeability of the first absorbing unit 10 to the waste liquid can be enhanced via the gap 110 between the porous absorbing body blocks 1. The known liquid absorber has a problem in that the mat spread in the container swells due to liquid absorption and is inhibited from further liquid absorption. However, with the first absorbing unit 10 according to the present embodiment, such a problem can be solved. In brief, since the waste liquid can immediately permeate through the gap 110 and thereafter be absorbed by the porous absorbing body blocks 1, inhibition of liquid absorption associated with swelling is unlikely to occur. Accordingly, the waste liquid can spread in the entirety of the first absorbing unit 10 housed in the container 9. Thus, the amount of waste liquid absorbed by the first absorbing unit 10 can be maximized. As a result, even when, for example, the liquid absorber 100, which has recovered the waste liquid, lies on its side, the waste liquid is less likely to leak.

Furthermore, the porous absorbing body blocks 1 are porous and have a density of 0.05 [g/cm$^3$] or more and 0.50 [g/cm$^3$] or less. The porous absorbing body blocks 1 having such a density also have good liquid permeability due to capillary action. This can further enhance liquid permeability in the first absorbing unit 10.

It is noted that when the density of the porous absorbing body blocks 1 falls below the lower limit value, the capillary action is unlikely to occur in the porous structure. Therefore, liquid permeability decreases. Also, the stiffness of the porous absorbing body blocks 1 decreases, and the bulk density of the first absorbing unit 10 decreases due to its own weight. On the other hand, when the density of the porous absorbing body blocks 1 exceeds the upper limit value, liquid permeability decreases.

As described above, the liquid absorber 100 according to the present embodiment includes the container 9 that has the upper opening 94 as an opening and that recovers the waste liquid of the ink Q which is a liquid. The liquid absorber 100 further includes the first absorbing unit 10 that is constituted by an aggregate of the porous absorbing body blocks 1 and that is housed in the container 9 such that a gap 110 exists between the porous absorbing body blocks 1. The density of the porous absorbing body blocks 1 is 0.05 [g/cm$^3$] or more and 0.50 [g/cm$^3$] or less.

According to such a configuration, the liquid absorber 100 including the porous absorbing body blocks 1 that are high in liquid permeability and that have good shape following properties in the container 9 can be achieved.

The density of the porous absorbing body blocks 1 is measured as follows.

First, the outer size of a porous absorbing body block 1 is measured in a natural state without a load applied, and the apparent volume of the porous absorbing body block 1 is calculated. Next, the mass of the porous absorbing body block 1 in a dried state is measured. Then, the measured mass is divided by the apparent volume to calculate the density of the porous absorbing body block 1.

The shape of the porous absorbing body blocks 1 is not particularly limited as long as they are block-like. In FIG. 4, the porous absorbing body block 1 has the shape of a substantially rectangular parallelepiped. Among the surfaces of the porous absorbing body block 1 illustrated in FIG. 4, two surfaces having the largest area are defined as main surfaces 1001 and 1001. The shape of each of the main surfaces 1001 and 1001 is a substantial rectangle having first edges 1002 and 1002 as two long edges and second edges 1003 and 1003 as two short edges. Also, four edges linking the main surfaces 1001 and 1001 are defined as third edges 1004, 1004, 1004, and 1004.

In the porous absorbing body block 1, the longest edge is defined as a "first longest edge". In the present embodiment, the two first edges 1002 and 1002 correspond to the first longest edge. Also, in the porous absorbing body block 1, the shortest edge is defined as a "first shortest edge". In the present embodiment, the four third edges 1004, 1004, 1004, and 1004 correspond to the first shortest edge.

As described above, the length of the first longest edge of each porous absorbing body block 1 (for example, the length L1 in FIG. 2) may be any length that can be housed in the container 9 when elongated. However, it is preferably ½ or less and more preferably ⅓ or less of the length of the shortest edge of the upper opening 94 (for example, the length L2 in FIG. 2). Specifically, the shape of the upper opening 94 as an opening of the container 9 is, as illustrated in FIG. 2, a rectangle having two long edges 941 and 941 as well as two short edges 942 and 942. The length of the first longest edge as the longest edge of each porous absorbing body block 1 is preferably ½ or less of the length of the short edge 942 as the shortest edge among the plurality of edges of the upper opening 94.

According to such a configuration, the shape following properties of the first absorbing unit 10 can be further enhanced in the housing space 93 of the container 9. This can further enhance the charged rate of the first absorbing unit 10 in the container 9. Also, the absorption amount associated with the capillary action of the porous absorbing body blocks 1 can be sufficiently ensured. Furthermore, workability in housing the porous absorbing body blocks 1 in the housing space 93 can be enhanced. It is noted that when the length of the first longest edge exceeds the upper limit value, the porous absorbing body blocks 1 are particularly highly likely to overlap each other. This can excessively reduce the bulk density of the block aggregate 11, leading to a reduction in liquid absorption properties of the first absorbing unit 10.

It is noted that the lower limit value of the length of the first longest edge is not particularly limited, but it is preferably 1/1000 or more and more preferably 1/500 or more of the length of the shortest edge of the upper opening 94, from the viewpoint of sufficiently ensuring the gap 110 between the porous absorbing body blocks 1.

Also, although the shape of the main surface 1001 is a rectangle in the present embodiment, it is not limited to a rectangle and may be another shape.

Furthermore, since the housing space 93 in the container 9 according to the present embodiment has the shape of a rectangular parallelepiped, the shape and size of a cross section of the housing space 93 cut along a plane normal to the vertical axis which is parallel to the up and down direction in FIG. 1 are the same as the shape and size of the upper opening 94. Therefore, in the present embodiment, the length of the first longest edge of each porous absorbing body block 1 is preferably ½ or less and more preferably ⅓ or less of the length of the shortest edge in a cross section of the housing space 93 of the container 9 cut along a plane normal to the vertical axis. This can provide the same effects as above. The same applies to the lower limit value.

On the other hand, the shape of the housing space 93 is not limited to a rectangular parallelepiped and may be another shape. For example, the area of a cross section cut along a plane normal to the vertical axis may not be constant and may change along the vertical axis. In this case, the length of the first longest edge of each porous absorbing body block 1 is also preferably ½ or less and more preferably ⅓ or less of the length of the shortest edge in the cross section. This can provide the same effects as above. The same applies to the lower limit value.

Also, the shape of the upper opening 94 and the shape of the cross section are not limited to a rectangle and may be a shape having a plurality of edges such as a square, a hexagon, or an octagon, that is, a polygon.

Furthermore, the shape of the upper opening 94 and the shape of the cross section may be not only a polygon but also a different shape such as a circle including a perfect circle, an oval, and an ellipse. In this case, the longest possible line segment taken in the upper opening 94 or the cross section may be regarded as the above-described "shortest edge".

The length of the first longest edge of each porous absorbing body block 1 is, as described above, preferably set depending on the size or the like of the container 9. However, for example, the length is preferably 5 mm or more and 50 mm or less. This can result in the porous absorbing body blocks 1 that are good in handleability and that are unlikely to be distributed unevenly in the housing space 93.

Also, a first aspect ratio that is a ratio of the length of the first longest edge to the length of the first shortest edge is, for example, preferably 5 or more and more preferably 10 or more and 100 or less. This can achieve an appropriate bulk density in the block aggregate 11 and can further enhance liquid permeability in the first absorbing unit 10. Also, when the length of the first longest edge is in the above-described range, and the first aspect ratio is in the above-described range, the length of the first shortest edge is larger than the thickness of common paper. Therefore, it can be said that the porous absorbing body blocks 1 are thicker than paper, specifically 0.1 mm or more and 20 mm or less in thickness, and are porous and less dense than paper.

It is noted that the plurality of porous absorbing body blocks 1 may be the same as or different from each other in shape, size, constituent material, and the like.

Here, when the density of the porous absorbing body blocks 1 is defined as A [g/cm$^3$], the bulk density of the block aggregate 11 is preferably 0.25 A [g/cm$^3$] or more and 1.50 A [g/cm$^3$] or less, and more preferably 0.40 A [g/cm$^3$] or more and 1.20 A [g/cm$^3$] or less. Accordingly, the first absorbing unit 10 has sufficient liquid permeability, and inhibition of liquid absorption associated with swelling is less likely to occur.

The bulk density of the block aggregate 11 is measured as follows.

First, the outer size of the block aggregate 11 housed in the container 9 is measured, and the apparent volume of the block aggregate 11 is calculated. When an element other than the porous absorbing body blocks 1, as an element of the first absorbing unit 10, is housed in the container 9, the volume including the element is calculated as the apparent volume of the block aggregate 11. Next, the mass of only the block aggregate 11 having its volume measured is measured. Then, the measured mass is divided by the apparent volume to calculate the bulk density of the block aggregate 11.

It is noted that the bulk density of the block aggregate 11 can be adjusted by, for example, changing the shape such as the length, aspect ratio, and degree of curvature of the porous absorbing body blocks 1. Specifically, for example, increasing the degree of curvature (reducing the bend radius) of the porous absorbing body blocks 1 can reduce the bulk density of the block aggregate 11.

The constituent material of the porous absorbing body blocks 1 is not particularly limited as long as it is a porous body. However, it is preferable that fibers 12 be contained as illustrated in FIG. 4. Examples of the fibers 12 include synthetic resin fibers such as polyester fibers and polyamide fibers; and natural resin fibers such as cellulose fibers, keratin fibers, fibroin fibers, and chemically modified products thereof. These may be used alone or in appropriate combinations.

Examples of the polyester fibers include polyethylene terephthalate (PET) fibers, polyethylene naphthalate (PEN) fibers, polytrimethylene terephthalate (PTT) fibers, and polytributylene terephthalate (PBT) fibers.

Examples of the polyamide fibers include aliphatic polyamide fibers such as nylon and aromatic polyamide fibers such as aramid.

Cellulose fibers have a fibrous shape and contain, as a main component, cellulose as a compound, that is, cellulose in a narrow sense. It is noted that cellulose fibers may contain hemicellulose, lignin, and the like, in addition to cellulose.

The fibers 12 may be contained in the state of a cloth such as a woven fabric or a nonwoven fabric, or the fibers 12 may be contained by themselves. When a cloth is used, the number of cloths used may be one or two or more. When two or more cloths are used, elements other than the cloths, such as the fibers 12 alone and the later-described additives, are preferably sandwiched between the cloths. This can prevent the fibers 12 and the like from falling off the porous absorbing body blocks 1.

The porous absorbing body blocks 1 may further contain various additives. Examples of the additives include binders, flame retardants, surfactants, lubricants, defoamers, fillers, blocking inhibitors, UV absorbers, colorants, fluidity improvers, and water-absorbing resins. In addition, the first absorbing unit 10 may also contain these additives.

Among these, the binders bind the fibers 12 together through heat fusion to ensure the shape retention properties of the porous absorbing body blocks 1. Examples of the binders include thermoplastic resins. Examples of the thermoplastic resins include polyvinyl acetate, polyvinyl alcohol, polyvinyl butyral, polystyrene, acrylonitrile butadiene styrene (ABS) resins, methacrylic resins, Noryl resins, polyurethane, ionomer resins, cellulose-based plastics, polyethylene, polypropylene, polyamide, polycarbonate, polyacetal, polyphenylene sulfide, polyvinylidene chloride, polyethylene terephthalate, and fluorine resins.

The flame retardants impart flame retardant properties to the porous absorbing body blocks 1. Examples of the flame retardants include halogen-based flame retardants, phosphorus-based flame retardants, nitrogen compound-based flame retardants, silicone-based flame retardants, and inorganic flame retardants.

The average length of the fibers 12 is preferably, but not limited to, 0.1 mm or more and 7.0 mm or less, more preferably 0.1 mm or more and 5.0 mm or less, and further preferably 0.2 mm or more and 3.0 mm or less.

The average diameter of the fibers 12 is preferably, but not limited to, 0.05 mm or more and 2.00 mm or less, and more preferably 0.10 mm or more and 1.00 mm or less.

The average aspect ratio, that is, the ratio of the average length to the average diameter, of the fibers 12 is preferably, but not limited to, 10 or more and 1000 or less, and more preferably 15 or more and 500 or less.

It is noted that the average length and the average diameter of the fibers 12 are respectively the average value of the length and the average value of the diameters of 100 or more fibers 12.

A method of producing such porous absorbing body blocks 1 is not particularly limited. However, for example, the production method includes mixing and defibrating the fibers 12 and additives by a dry or wet method, thereafter depositing the defibrated product into a layer, and compressing the deposited layer to prepare a mat; and cutting the mat to prepare the porous absorbing body blocks 1.

It is noted that the mat may be a stack of a plurality of sheets. In this case, the plurality of sheets of the stack may have the same structure or different structures.

The above-described block aggregate 11 constituting the first absorbing unit 10 may be charged into the housing space 93 at a uniform bulk density or at a partially varied bulk density.

Also, the image forming apparatus 200 illustrated in FIG. 1 includes the liquid absorber 100 that contains such a first absorbing unit 10. The liquid absorber 100 is charged with the porous absorbing body blocks 1 that are high in liquid permeability and that have good shape following properties in the container 9. Therefore, the waste liquid can spread in the entirety of the first absorbing unit 10, and the amount of waste liquid absorbed by the first absorbing unit 10 can be maximized. As a result, there can be achieved the image forming apparatus 200 that can recover a larger amount of waste liquid and that is unlikely to cause a failure such as waste liquid leakage.

2. Modification of First Embodiment

Next, a liquid absorber according to a modification of the first embodiment will be described.

Figure 5:
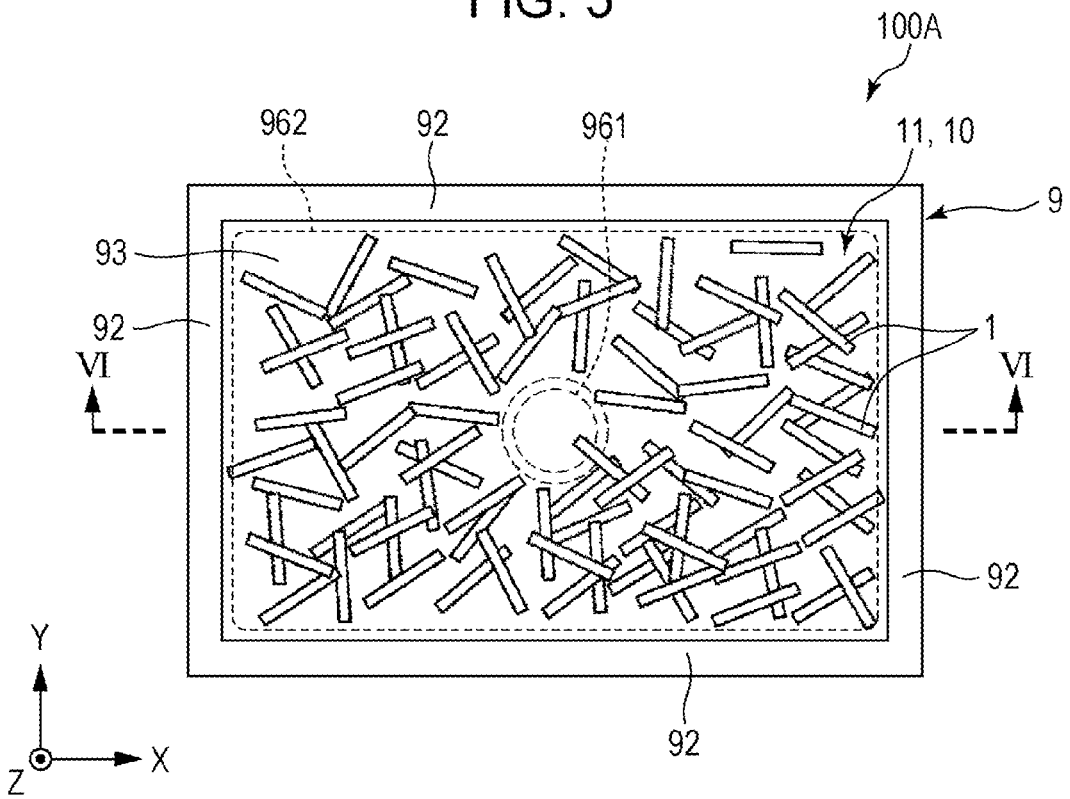
FIG. 5 is a plan view illustrating a liquid absorber according to a modification of the first embodiment.
Figure 6:
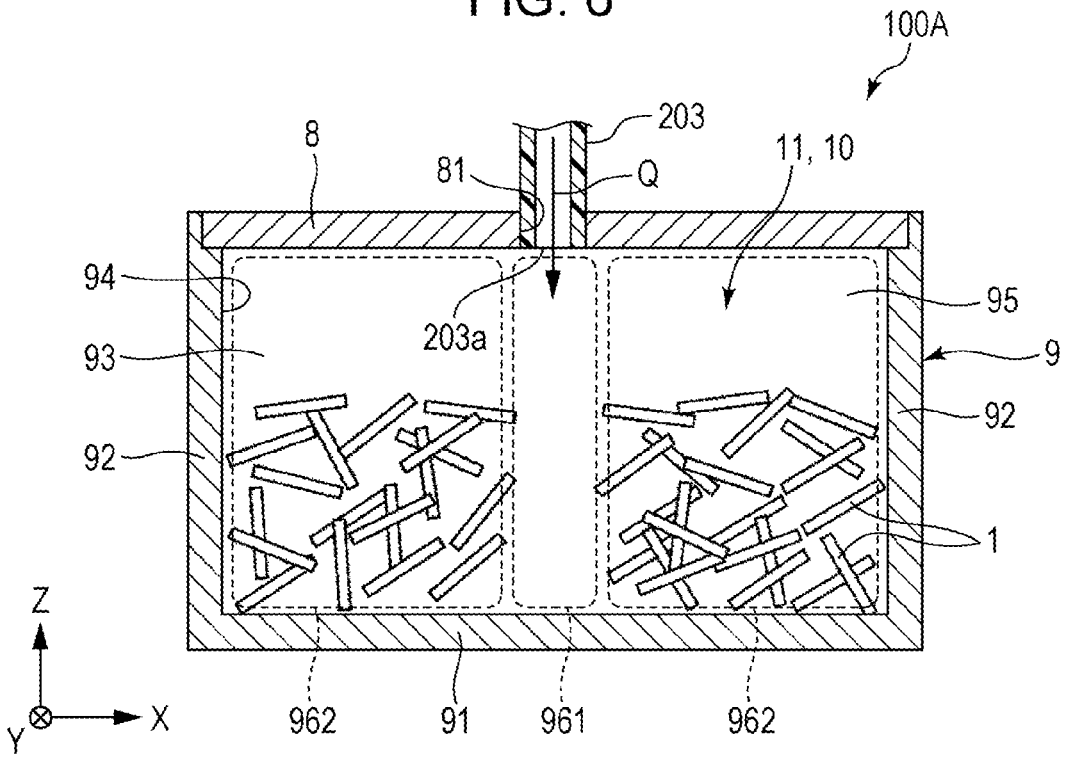
FIG. 6 is a sectional view taken along line VI-VI of FIG. 5.

FIG. 5 is a plan view illustrating a liquid absorber according to a modification of the first embodiment. FIG. 6 is a sectional view taken along line VI-VI of FIG. 5.

Hereinafter, the modification will be described. In the following description, a difference from the first embodiment will be mainly described, and the description of similar features will be omitted. It is noted that the same components as in the first embodiment are labeled with the same reference numerals in FIG. 5 and FIG. 6.

In a liquid absorber 100A illustrated in FIG. 5 and FIG. 6, the bulk density of the block aggregate 11 housed in the housing space 93 partially varies. Specifically, a position in which the waste liquid of the ink Q drops into the container 9 is defined as a "drop position 961", and a position other than the drop position 961 is defined as a "non-drop position 962". The bulk density of the block aggregate 11 in the drop position 961 is preferably lower than the bulk density of the block aggregate 11 in the non-drop position 962.

According to such a configuration, the waste liquid of the ink Q dropped in the drop position 961 can be prevented from accumulating in the drop position 961. That is, when the liquid permeability in the drop position 961 is higher than that in the non-drop position 962, the waste liquid of the ink Q dropped in the drop position 961 can immediately move toward the non-drop position 962. Accordingly, the waste liquid of the ink Q can be absorbed by the entirety of the liquid absorber 100A, and the first absorbing unit 10 is used without waste. This can further increase the amount of the waste liquid that can be absorbed.

It is noted that the bulk density of the block aggregate 11 in the drop position 961 denotes a density of the block aggregate 11 calculated in an assumed columnar region that has a bottom surface in a range where the waste liquid dropped from the discharge port 203*a* splatters in the housing space 93. Specifically, the bulk density is obtained by dividing the mass of the block aggregate 11 contained in this columnar region by the volume of the columnar region.

It is noted that the columnar region is a region along the entire length of the vertical axis of the housing space 93. Therefore, the columnar region is a region that also contains the void 95 into which the block aggregate 11 is not charged. Therefore, to reduce the bulk density of the block aggregate 11 in the drop position 961, for example, the height of the block aggregate 11 stacked in the drop position 961 may be lower than that in the non-drop position 962 as illustrated in FIG. 6.

Similarly, the bulk density of the block aggregate 11 in the non-drop position 962 denotes a density of the block aggregate 11 calculated in an assumed columnar region that has a bottom surface in a range other than the drop position 961 in the housing space 93.

It is noted that a partition or the like (not illustrated) may be disposed at a boundary between the drop position 961 and the non-drop position 962. Accordingly, the above-described difference in bulk density can be maintained even when the liquid absorber 100A is tilted.

Also, when a partition is disposed, the porous absorbing body blocks 1 charged into the drop position 961 may have a different structure from the porous absorbing body blocks 1 charged into the non-drop position 962. Specifically, when the shape such as the length, aspect ratio, or degree of curvature is varied, the bulk density of the resulting block aggregate 11 can be varied.

Accordingly, a difference in the bulk density of the block aggregate 11 can be achieved even when, for example, the stack height is the same.

It is noted that the partition disposed in the housing space 93 may be integrated with or separated from the container 9. The partition may be produced with the same material as the constituent material of the porous absorbing body blocks 1.

The above-described modification can have the same effects as in the first embodiment.

3. Second Embodiment

Next, a liquid absorber according to a second embodiment will be described.

Figure 7:
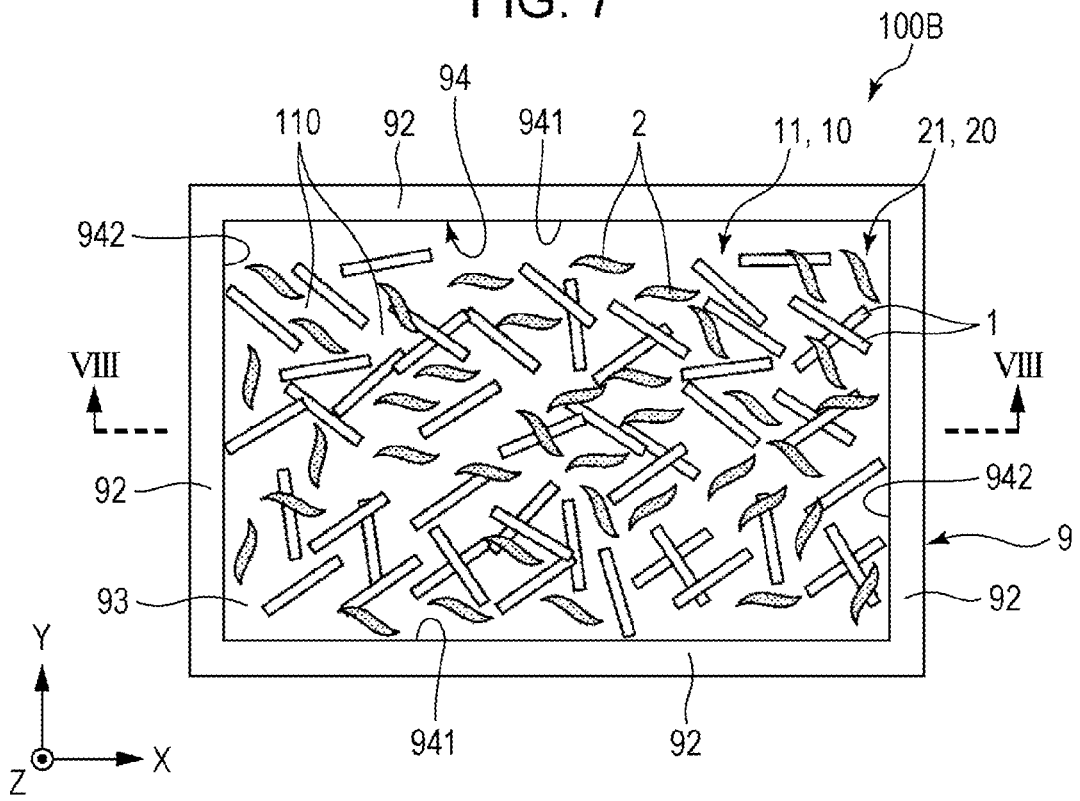
FIG. 7 is a plan view illustrating a liquid absorber according to a second embodiment.
Figure 8:
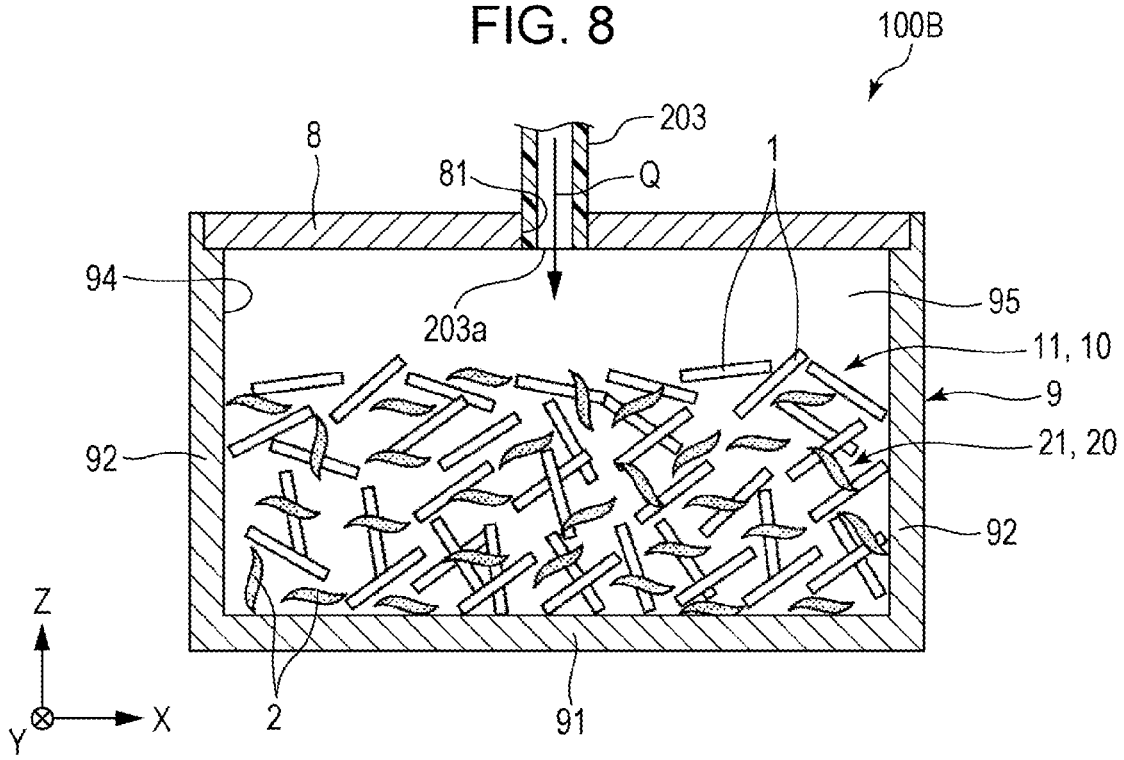
FIG. 8 is a sectional view taken along line VIII-VIII of FIG. 7.
Figure 9:
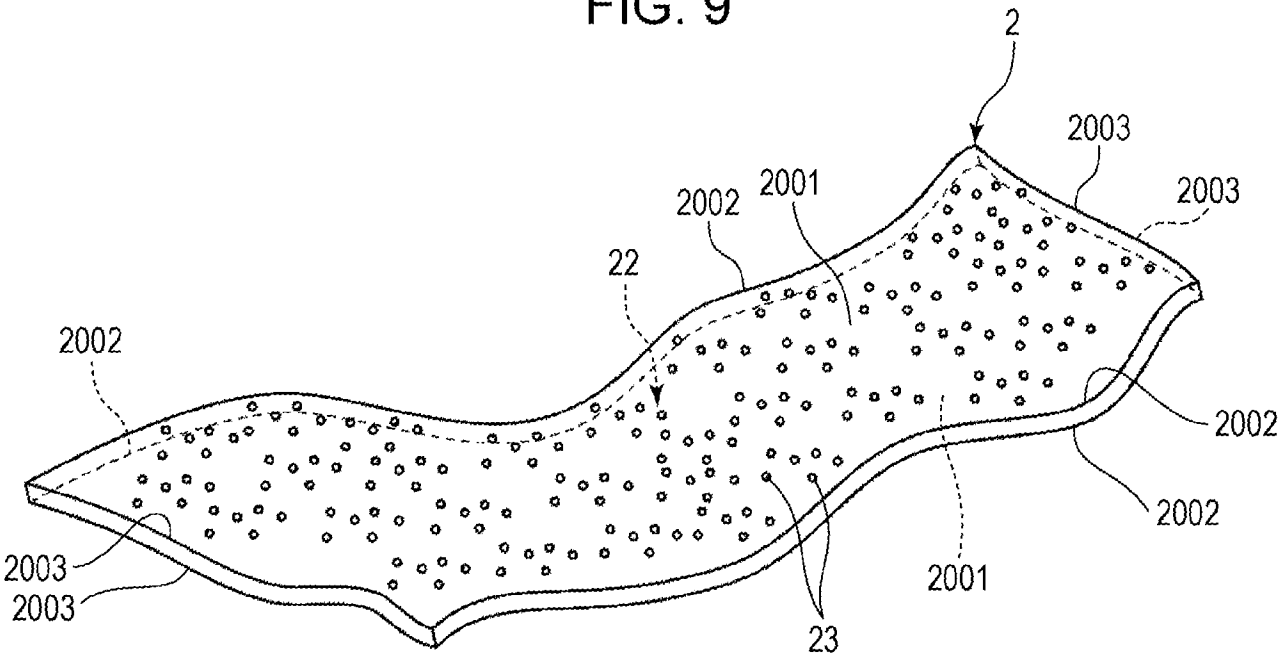
FIG. 9 is a perspective view illustrating an example of a small piece contained in the second absorbing body of FIG. 7.

FIG. 7 is a plan view illustrating the liquid absorber according to the second embodiment. FIG. 8 is a sectional view taken along line VIII-VIII of FIG. 7. FIG. 9 is a perspective view illustrating an example of a small piece 2 contained in a second absorbing unit 20 of FIG. 7.

Hereinafter, the second embodiment will be described. In the following description, a difference from the first embodiment will be mainly described, and the description of similar features will be omitted. It is noted that the same components as in the first embodiment are labeled with the same reference numerals in FIG. 7 to FIG. 9.

A liquid absorber 100B according to the second embodiment is the same as the liquid absorber 100 according to the first embodiment, except for further including the second absorbing unit 20 in addition to the first absorbing unit 10.

The liquid absorber 100B illustrated in FIG. 7 and FIG. 8 includes the container 9 as well as the first absorbing unit 10 and the second absorbing unit 20 housed in the container 9. The first absorbing unit 10 and the second absorbing unit 20 are mixed with each other. The second absorbing unit 20 is constituted by a small piece aggregate 21 which is a collection of small pieces 2.

The small pieces 2 contain, as illustrated in FIG. 9, a fiber substrate 22 that contains fibers and a water-absorbing resin 23 supported by the fiber substrate 22.

In this manner, the liquid absorber 100B further includes the second absorbing unit 20 constituted by the small piece aggregate 21 that includes the fiber substrate 22 as a substrate including fibers and the water-absorbing resin 23 as a polymeric absorbing body supported by the fiber substrate 22. The second absorbing unit 20 is housed in the container 9 so as to be mixed with the first absorbing unit 10.

According to such a configuration including the second absorbing unit 20 in addition to the first absorbing unit 10, liquid permeability increases. By taking advantage of such high liquid permeability, the waste liquid of the ink Q which permeated the first absorbing unit 10 can be delivered to the second absorbing unit 20. Since the second absorbing unit 20 includes the small pieces 2 that contain the water-absorbing resin 23, it retains the delivered waste liquid of the ink Q. This can prevent the leak of the waste liquid of the ink Q recovered into the container 9.

Also, since the second absorbing unit 20 is constituted by the small piece aggregate 21, the shape following properties of the second absorbing unit 20 can be further enhanced in the housing space 93 of the container 9. This can further enhance the charged rate of the second absorbing unit 20 in the container 9.

In addition, since the first absorbing unit 10 and the second absorbing unit 20 are mixed, the first absorbing unit 10, which primarily plays a role in enabling permeation of the waste liquid, and the second absorbing unit 20, which primarily plays a role in absorbing and retaining the waste liquid, can be spatially separated without interfering with each other while being close to each other. Accordingly, uneven distribution of the water-absorbing resins 23 is suppressed. This can prevent the problem that further liquid absorption by the water-absorbing resin 23 is inhibited in association with the swelling of the water-absorbing resin 23. Also, since there is a high probability in which the porous absorbing body blocks 1 and the small pieces 2 are adjacent to each other, the porous absorbing body blocks 1 can deliver the waste liquid to the water-absorbing resin 23 in the entirety of the container 9 so as to increase the probability of bringing the waste liquid into contact with the water-absorbing resin 23. As a result, the amount of waste liquid absorbed by the liquid absorber 100B can be maximized.

Furthermore, when the form of the porous absorbing body blocks 1 and the small pieces 2 is employed, the mixing ratio between the first absorbing unit 10 and the second absorbing unit 20 can be partially changed. Accordingly, a balance between the liquid permeability and the absorption amount required of the liquid absorber 100B can be struck.

The mixing ratio between the first absorbing unit 10 and the second absorbing unit 20 housed in the container 9 is not particularly limited and is appropriately set based on the liquid permeability and the absorption amount required of the liquid absorber 100B.

The mass of the first absorbing unit 10 is preferably 10% or more and 90% or less, more preferably 20% or more and 90% or less, and further preferably 30% or more and 80% or less, of the mass of the second absorbing unit 20. This can achieve a good balance between the liquid permeability and the absorption amount and ensure sufficient absorption amounts while preventing the problem that liquid absorption is inhibited.

It is noted that when the mass of the first absorbing unit 10 is lower than the lower limit value, the ratio of the porous absorbing body blocks 1 decreases, which relatively increases the ratio of the small pieces 2. This can increase the probability of causing the problem that liquid absorption is inhibited. On the other hand, when the mass of the first absorbing unit 10 exceeds the upper limit value, the ratio of the porous absorbing body blocks 1 increases, which relatively decreases the ratio of the small pieces 2. Accordingly, the recovered waste liquid cannot be sufficiently retained and can leak.

The small piece 2 illustrated in FIG. 9 has a plate-like shape having two main surfaces 2001 and 2001 which have a relationship of the front and the back to each other. The water-absorbing resin 23 may be supported by one or both of the two main surfaces 2001 and 2001 of the small piece 2 illustrated in FIG. 9 or may be supported inside the small piece 2.

The fiber substrate 22 has a plate-like shape constituted by an aggregate of fibers as illustrated in FIG. 9. Examples of the fibers include the above-described synthetic resin fibers and natural resin fibers. Alternatively, the small piece 2 may have a "sandwiched" shape in which the water-absorbing resin 23 is sandwiched between the fiber substrates 22.

The water-absorbing resin 23 is supported by the fiber substrate 22 in this manner. Accordingly, the waste liquid of the ink Q can be retained by the fiber substrate 22 and thereafter delivered to the water-absorbing resin 23. This enhances the absorption efficiency of the waste liquid of the ink Q in the second absorbing unit 20.

The shape and the like of the fibers contained in the fiber substrate 22 are the same as those of the above-described fibers 12.

The water-absorbing resin 23 is not particularly limited, as long as it is a resin having water absorbability. Examples thereof include carboxymethyl cellulose, polyacrylic acid, polyacrylamide, starch-acrylic acid graft copolymers, hydrolysates of starch-acrylonitrile graft copolymers, vinyl acetate-acrylic acid ester copolymers, copolymers or the like of isobutylene and maleic acid, hydrolysates of acrylonitrile copolymers or acrylamide copolymers, polyethylene oxide, polysulfonic acid-based compounds, polyglutamic acid, and salts, neutralized products, or crosslinked bodies thereof. Here, water absorbability refers to the function of having hydrophilicity and retaining moisture. It is noted that the water-absorbing resin 23 is often gelled when it absorbs water.

Among these, the water-absorbing resin 23 is preferably a resin having a functional group on a side chain. Examples of the functional group include an acid group, a hydroxyl group, an epoxy group, and an amino group. In particular, the water-absorbing resin 23 is preferably a resin having an acid group on a side chain and more preferably a resin having a carboxyl group on a side chain.

Examples of the carboxyl group-containing unit constituting the side chain include those derived from monomers such as acrylic acid, methacrylic acid, itaconic acid, maleic acid, crotonic acid, fumaric acid, sorbic acid, cinnamic acid, and anhydrides, salts, or the like thereof.

When the water-absorbing resin 23 having an acid group on the side chain is included, the ratio of acid groups neutralized to form a salt to acid groups contained in the water-absorbing resin 23 is preferably 30 mol % or more and 100 mol % or less, more preferably 50 mol % or more and 95 mol % or less, further preferably 60 mol % or more and 90 mol % or less, and most preferably 70 mol % or more and 80 mol % or less. This can further improve the liquid absorbability of the water-absorbing resin 23.

The type of the salt obtained through neutralization is not particularly limited. Examples thereof include alkali metal salts such as sodium salts, potassium salts, and lithium salts and salts of nitrogen-containing basic compounds such as ammonia. Among these, sodium salts are preferable. This can further improve the liquid absorbability of the water-absorbing resin 23.

The water-absorbing resin 23 having an acid group on the side chain is preferable, because electrostatic repulsion is caused among acid groups when liquid is absorbed, and the absorption speed increases. Also, when acid groups are neutralized, liquid is easily absorbed into the inside of the water-absorbing resin 23 due to osmotic pressure.

The water-absorbing resin 23 may have a constituent unit containing no acid group on the side chain. Examples of such a constituent unit include a hydrophilic constituent unit, a hydrophobic constituent unit, and a constituent unit serving as a polymerizable crosslinking agent.

Examples of the hydrophilic constituent unit include constituent units derived from nonionic compounds such as acrylamide, methacrylamide, N-ethyl(meth)acrylamide, N-n-propyl(meth)acrylamide, N-isopropyl(meth)acrylamide, N,N-dimethyl(meth)acrylamide, 2-hydroxyethyl (meth) acrylate, 2-hydroxypropyl (meth)acrylate, methoxypolyethylene glycol (meth)acrylate, polyethylene glycol mono (meth)acrylate, N-vinylpyrrolidone, N-acryloylpiperidine, and N-acryloylpyrrolidine. As described herein, (meth)acryl and (meth)acrylate denote acryl or methacryl and acrylate or methacrylate.

Examples of the hydrophobic constituent unit include constituent units derived from compounds such as (meth) acrylonitrile, styrene, vinyl chloride, butadiene, isobutene, ethylene, propylene, stearyl (meth)acrylate, and lauryl (meth)acrylate.

Examples of the constituent unit serving as a polymerizable crosslinking agent include constituent units derived from diethylene glycol diacrylate, N,N-methylenebisacrylamide, polyethylene glycol diacrylate, polypropylene glycol diacrylate, trimethylolpropane diallyl ether, trimethylolpropane triacrylate, allyl glycidyl ether, pentaerythritol triallyl ether, pentaerythritol diacrylate monostearate, bisphenol diacrylate, isocyanuric acid diacrylate, tetraallyloxyethane, diallyloxyacetate, and the like.

In particular, the water-absorbing resin 23 preferably contains a polyacrylate copolymer or a polyacrylic acid polymer crosslinked body. This provides advantages such as an improvement in liquid absorption performance and a reduction in production costs.

In the polyacrylic acid polymer crosslinked body, the ratio of carboxyl group-containing constituent units to all constituent units of the molecular chain is preferably 50 mol % or more, more preferably 80 mol % or more, and further preferably 90 mol % or more. When the ratio of the carboxyl group-containing constituent units is excessively low, it may be difficult to ensure sufficiently good liquid absorption performance.

It is preferable that the carboxyl groups in the polyacrylic acid polymer crosslinked body are partly neutralized, that is, partly neutralized to form a salt. The ratio of the neutralized carboxyl groups relative to all carboxyl groups in the polyacrylic acid polymer crosslinked body is preferably 30 mol % or more and 99 mol % or less, more preferably 50 mol % or more and 99 mol % or less, and further preferably 70 mol % or more and 99 mol % or less.

Also, the water-absorbing resin 23 may have a structure crosslinked with a crosslinking agent other than the above-described polymerizable crosslinking agent.

When the water-absorbing resin 23 is a resin having an acid group, a compound having a plurality of functional groups that react with an acid group, for example, can be preferably used as a crosslinking agent.

When the water-absorbing resin 23 is a resin having a functional group that reacts with an acid group, a compound having in the molecule a plurality of functional groups that react with an acid group can be suitably used as a crosslinking agent.

Examples of the compound having a plurality of functional groups that react with an acid group include glycidyl ether compounds such as ethylene glycol diglycidyl ether, trimethylolpropane triglycidyl ether, (poly)glycerol polyglycidyl ether, diglycerol polyglycidyl ether, and propylene glycol diglycidyl ether; polyhydric alcohols such as (poly) glycerol, (poly)ethylene glycol, propylene glycol, 1,3-propanediol, polyoxyethylene glycol, triethylene glycol, tetraethylene glycol, diethanolamine, and triethanolamine; and polyvalent amines such as ethylenediamine, diethylenediamine, polyethyleneimine, and hexamethylenediamine. Also, polyvalent ions such as zinc, calcium, magnesium, and aluminum can be suitably used, because they react with an acid group in the water-absorbing resin 23 so as to act as a crosslinking agent.

The water-absorbing resin 23 may be of any shape, for example, scaly, needle-like, fibrous, or particle-like. Preferably, most of the water-absorbing resin 23 has a particle-like shape. When the water-absorbing resin 23 has a particle-like shape, liquid permeability can be easily ensured. Also, the fiber substrate 22 can suitably support the water-absorbing resin 23. It is noted that the particle-like shape refers to a shape in which the aspect ratio, that is, the ratio of the minimum length to the maximum length, is 0.3 or more and 1.0 or less. The average particle diameter of particles is preferably 50 μm or more and 800 μm or less, more preferably 100 μm or more and 600 μm or less, and further preferably 200 μm or more and 500 μm or less. The average particle diameter of particles refers to the average value of particle diameters determined for 100 or more particles.

Also, in the small pieces 2, the mass ratio of the water-absorbing resin 23 to the fiber substrate 22 is preferably 0.15 or more and 1.75 or less, more preferably 0.20 or more and 1.50 or less, and further preferably 0.25 or more and 1.20 or less. This can further improve the balance between the liquid permeability attributed to the fiber substrate 22 and the liquid absorbability attributed to the water-absorbing resin 23 in the small pieces 2.

The small pieces 2 may further contain various additives. Examples of the additives include surfactants, lubricants, defoamers, fillers, blocking inhibitors, UV absorbers, colorants, flame retardants, and fluidity improvers.

A method of producing such small pieces 2 is not particularly limited. An example thereof is a method that includes causing the water-absorbing resin 23 to be supported by a base material for obtaining the fiber substrate 22 and cutting (cracking) the base material supporting the water-absorbing resin 23 to obtain the small pieces 2 as cut fragments (cracked fragments).

Here, the small piece 2 illustrated in FIG. 9 has a plate-like shape including two main surfaces 2001 and 2001 which have a relationship of the front and the back to each other. The shape of each of the main surfaces 2001 and 2001 is a substantial rectangle having fourth edges 2002 and 2002 as two long edges and fifth edges 2003 and 2003 as two short edges.

The longest edge of each of the main surfaces 2001 of the small pieces 2 is defined as a "second longest edge". In the present embodiment, the two fourth edges 2002 and 2002 correspond to the second longest edge. Also, the shortest edge of each of the main surfaces 2001 of the small pieces 2 is defined as a "second shortest edge". In the present embodiment, the two fifth edges 2003 and 2003 correspond to the second shortest edge.

The length of the first longest edge and the length of the second longest edge are each preferably 5 mm or more and 50 mm or less. Also, a first aspect ratio that is the ratio of the length of the first longest edge to the length of the first shortest edge and a second aspect ratio that is the ratio of the length of the second longest edge to the length of the second shortest edge are each preferably 5 or more, and more preferably 10 or more and 100 or less.

Such a configuration suppresses uneven distribution due to a difference in specific gravity when the first absorbing unit 10 and the second absorbing unit 20 are mixed. This can prevent problems associated with uneven distribution, such as the inhibition of liquid absorption associated with uneven distribution of the water-absorbing resins 23 and the decrease in absorption amount (retention amount) associated with uneven distribution of the porous absorbing body blocks 1. Also, the length of the first shortest edge and the length of the second shortest edge are each larger than the thickness of common paper. Therefore, a balance between excellent liquid permeability attributed to the porous absorbing body blocks 1 and excellent absorbability attributed to the small pieces 2 can be struck by including the porous absorbing body blocks 1 and the small pieces 2 as described above. Specifically, the porous absorbing body blocks 1 having a sufficient length and aspect ratio reduce the bulk density of the first absorbing unit 10, and thus the permeation path of the waste liquid can be ensured. Also, the small pieces 2 having a sufficient thickness and aspect ratio facilitate maintaining the mixed state of the porous absorbing body blocks 1 and the small pieces 2. This prevents the problem that liquid absorption is inhibited in association with the swelling of the water-absorbing resin 23.

The length of the second longest edge of each small piece 2 may be any length as long as the small pieces 2 in an elongated state can be housed in the container 9. However, the length is preferably ½ or less and more preferably ⅓ or less of the length of the shortest edge of the upper opening 94. Specifically, the shape of the upper opening 94 as an opening of the container 9 is, as illustrated in FIG. 7, a rectangle having two long edges 941 and 941 as well as two short edges 942 and 942. The length of the second longest edge as the longest edge of each small piece 2 is preferably ½ or less of the length of the short edge 942 as the shortest edge among the plurality of edges of the upper opening 94.

According to such a configuration, the shape following properties of the second absorbing unit 20 can be further enhanced in the housing space 93 of the container 9. This can further enhance the charged rate of the second absorbing unit 20 into the container 9. Also, since the bulk density of the small piece aggregate 21 is likely to increase, the amount of liquid absorbed in the second absorbing unit 20 can be further increased. Furthermore, workability in housing the small pieces 2 into the housing space 93 can be enhanced. It is noted that when the length of the second longest edge exceeds the above-described upper limit value, the small pieces 2 are particularly highly likely to overlap each other. This can unnecessarily increase the bulk density of the small pieces 2 to an excessive extent, leading to a reduction in shape following properties of the second absorbing unit 20.

The lower limit value of the length of the second longest edge is not particularly limited. However, the lower limit value is preferably 1/1000 or more and more preferably 1/500 or more, from the viewpoint of achieving a sufficient gap between the small pieces 2.

Also, although the shape of the main surface 2001 is a rectangle in the present embodiment, the shape of the main surface 2001 is not limited to a rectangle and may be another shape.

Furthermore, in the present embodiment, the length of the second longest edge of each small piece 2 is preferably ½ or less and more preferably ⅓ or less of the length of the shortest edge in a cross section of the housing space 93 of the container 9 cut along a plane normal to the vertical axis. This can provide the same effects as above. The same applies to the lower limit value.

On the other hand, the shape of the housing space 93 may be such that, for example, the area of a cross section cut along a plane normal to the vertical axis may not be constant and may change along the vertical axis. In this case, the length of the second longest edge of each small piece 2 is also preferably ½ or less and more preferably ⅓ or less of the length of the shortest edge in the cross section. This can provide the same effects as above. The same applies to the lower limit value.

The above-described second embodiment can have the same effects as in the first embodiment.

4. Modification of Second Embodiment

Next, a liquid absorber according to a modification of the second embodiment will be described.

Figure 10:
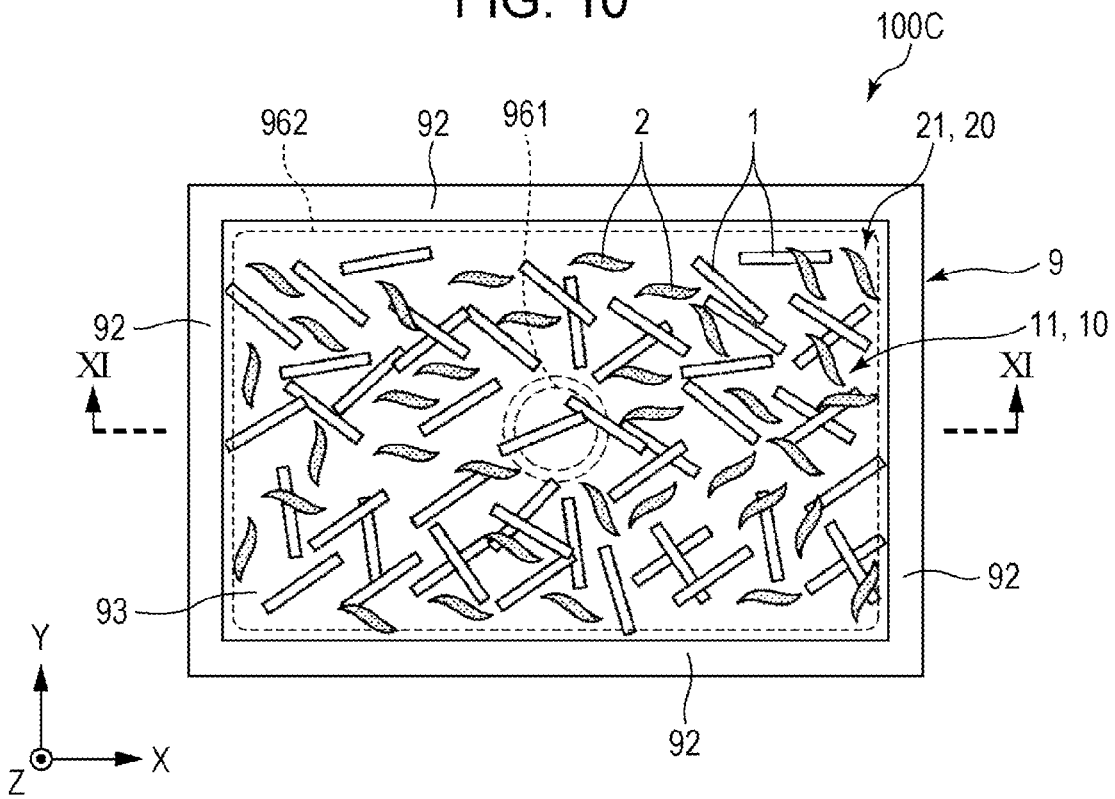
FIG. 10 is a plan view illustrating a liquid absorber according to a modification of the second embodiment.
Figure 11:
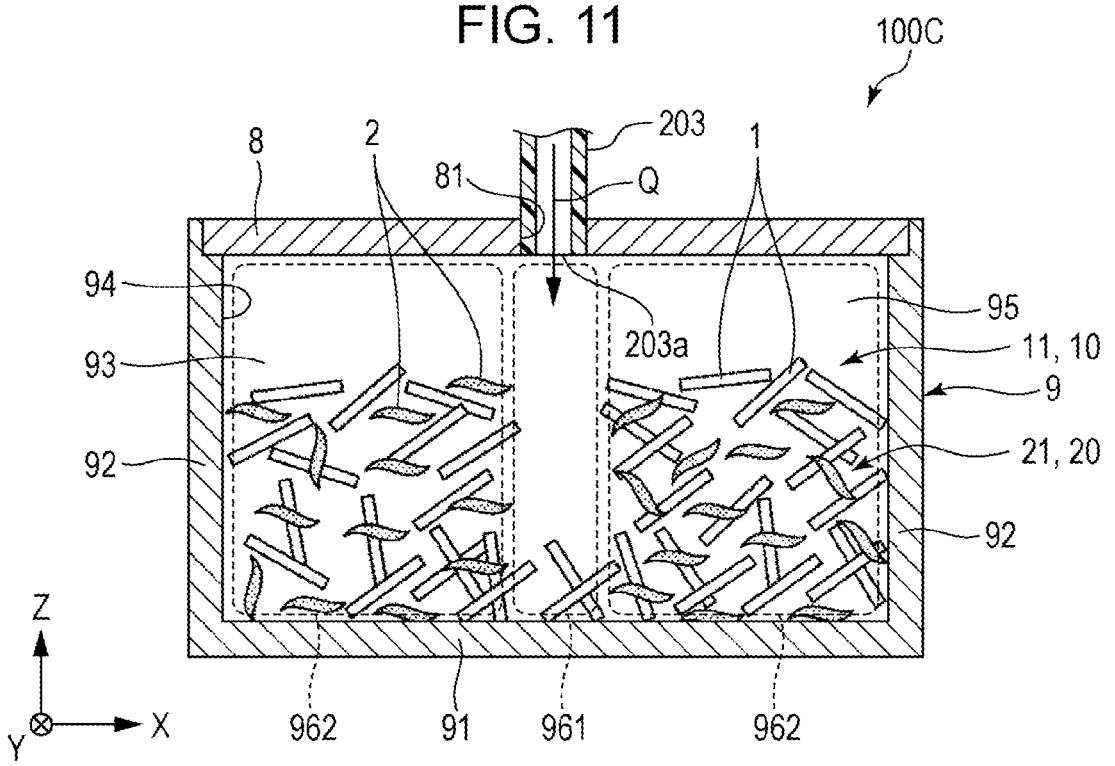
FIG. 11 is a sectional view taken along line XI-XI of FIG. 10.

FIG. 10 is a plan view illustrating a liquid absorber according to a modification of the second embodiment. FIG. 11 is a sectional view taken along line XI-XI of FIG. 10.

Hereinafter, the modification will be described. In the following description, a difference from the second embodiment will be mainly described, and the description of similar features will be omitted. It is noted that the same components as in the first embodiment are labeled with the same reference numerals in FIG. 10 and FIG. 11.

In a liquid absorber 100C illustrated in FIG. 10 and FIG. 11, the polymer mass ratio in the first absorbing unit 10 and the second absorbing unit 20 housed in the housing space 93 partially varies. Specifically, a position in which the waste liquid of the ink Q as liquid drops into the container 9 is defined as the above-described "drop position 961", and a position other than the drop position 961 is defined as the above-described "non-drop position 962". The polymer mass ratio in the drop position 961 is preferably lower than the polymer mass ratio in the non-drop position 962. The polymer mass ratio refers to the ratio of the mass of the water-absorbing resin 23 (polymeric absorbing body) to the total mass of the first absorbing unit 10 and the second absorbing unit 20.

According to such a configuration, the waste liquid of the ink Q dropped in the drop position 961 can be prevented from accumulating in the drop position 961. That is, when the polymer mass ratio of the drop position 961 is lower than the polymer mass ratio in the non-drop position 962, the drop position 961 is unlikely to have the problem that the waste liquid of the ink Q dropped in the drop position 961 causes the water-absorbing resin 23 to swell, and further liquid absorption and diffusion are inhibited due to blocking by the water-absorbing resin 23. Accordingly, the waste liquid of the ink Q dropped in the drop position 961 can immediately move toward the non-drop position 962. Thus, the waste liquid of the ink Q can be absorbed by the entirety of the first absorbing unit 10, and the first absorbing unit 10 is used without waste. This can further increase the amount of the waste liquid that can be absorbed.

It is noted that the polymer mass ratio in the drop position 961 refers to a polymer mass ratio calculated in an assumed columnar region that has a bottom surface in a range where the waste liquid dropped from the discharge port 203*a* splatters in the housing space 93.

Similarly, the polymer mass ratio in the non-drop position 962 refers to a polymer mass ratio calculated in an assumed columnar region that has a bottom surface in a range other than the drop position 961 in the housing space 93.

To vary the polymer mass ratio, for example, the mixing ratio between the first absorbing unit 10 and the second absorbing unit 20 may be varied. Specifically, the mixing ratio of the second absorbing unit 20 in the drop position 961 may be lower than the mixing ratio of the second absorbing unit 20 in the non-drop position 962.

It is noted that a partition or the like (not illustrated) may be disposed at a boundary between the drop position 961 and the non-drop position 962. Accordingly, the above-described difference in bulk density can be maintained even when the liquid absorber 100C is tilted.

The partition disposed in the housing space 93 may be integrated with or separated from the container 9. The partition may be produced with the same material as the constituent material of the porous absorbing body blocks 1.

The above-described modification can have the same effects as in the second embodiment.

It is noted that the first absorbing unit 10 and the second absorbing unit 20 may be mixed in the container 9 such that the ratio (the above-described polymer mass ratio) of the mass of the water-absorbing resin 23 (polymeric absorbing body) to the total mass of the first absorbing unit 10 is not more than 5% by mass, and the ratio (the above-described polymer mass ratio) of the mass of the water-absorbing resin 23 (polymeric absorbing body) to the total mass of the second absorbing unit 20 is not less than 5% by mass and preferably more than 5% by mass. Accordingly, the container 9 has a high region in which the water-absorbing resin 23 (polymeric absorbing body) is contained in a large amount and a low region in which the water-absorbing resin 23 (polymeric absorbing body) is contained in a small amount (or absent). In this case, the same effects as above are also obtained.

Although the liquid absorbers and the image forming apparatuses according to the illustrated embodiments of the present disclosure have been described above, the present disclosure is not limited thereto. The components constituting the liquid absorbers and the image forming apparatuses can be replaced with any component configured to provide the same function. Also, any structure may be added.

The liquid absorbers according to the embodiments of the present disclosure are used for applications of absorbing any liquid other than the waste liquid of ink.

Furthermore, an application of the liquid absorbers in the above-described embodiments may also be a "leaked ink receiver" that absorbs ink involuntarily leaked from an ink flow path of an image forming apparatus.

Also, the present disclosure may be a combination of two or more of the above-described embodiments.

EXAMPLES

Next, specific examples of the present disclosure will be described.

5. Preparation of Liquid Absorber

Example 1

Firstly, a raw material containing a nonwoven fabric, a cellulose fiber (pulp-defibrated cotton), a polyester fiber, and a flame retardant was blended and then defibrated in air. Thereafter, the defibrated product was deposited into a layer and compressed to prepare a mat. Subsequently, the mat was cut to obtain porous absorbing body blocks. It is noted that the mat had a thickness of 10 mm, and the shape of the main surfaces of the porous absorbing body blocks was a rectangle having a long edge length of 30 mm and a short edge length of 10 mm. The density of the porous absorbing body blocks alone is as illustrated in Table 1.

Next, the prepared porous absorbing body blocks were charged into a container having a rectangular parallelepiped-shaped housing space. Accordingly, a first absorbing unit constituted by an aggregate of the porous absorbing body blocks was obtained. The bulk density of the first absorbing unit at this time is as illustrated in Table 1. The upper opening of the container used had a rectangular shape with a short edge length of 100 mm. In this manner, a liquid absorber was obtained.

Examples 2 to 4

Liquid absorbers were obtained in the same manner as in Example 1, except that the configuration of the first absorbing unit was changed as illustrated in Table 1.

Comparative Examples 1 and 2

Liquid absorbers were obtained in the same manner as in Example 1, except that the configuration of the first absorbing unit was changed as illustrated in Table 1.

Example 5

A liquid absorber was obtained in the same manner as in Example 1, except that the below-described second absorbing unit was added in the container in addition to the first absorbing unit. The mixing ratio between the first absorbing unit and the second absorbing unit was 20:80 by mass.

First, a sheet of paper having a thickness of 0.5 mm was prepared as a sheet-like fiber substrate. Fibers contained in this paper had an average length of 0.71 mm, an average width of 0.2 mm, and an aspect ratio, defined by average length/average width, of 3.56. The weight of the paper was 4 g per sheet.

Subsequently, one surface of this paper was sprayed with 2 cc of pure water by an atomizer.

Then, the water-sprayed surface of the paper was coated with a SANFRESH ST-500MPSA manufactured by Sanyo Chemical Industries, Ltd., as a partial sodium salt cross-linked product of a polyacrylic acid polymer crosslinked body, which is a water-absorbing resin having a carboxyl group as an acid group in a side chain. The water-absorbing resin was applied while being sieved out through a mesh having an opening size of 0.106 mm, specifically a JTS-200-45-106 manufactured by Tokyo Screen Co., Ltd. The coating weight of the water-absorbing resin was 4 g.

The paper was folded in half such that a valley was formed on a surface to which the water-absorbing resin adhered. The folded paper was pressurized and heated in the thickness direction using a pair of heating blocks. The pressurization was performed at 0.3 kg/cm$^2$, and the heating temperature was 100° C. The heating and pressurization time was 2 minutes.

Then, the heating and pressurization was terminated. After the folded paper reached normal temperature, it was shredded into small pieces having a size of 2 mm×15 mm and a thickness of 1.0 mm. Accordingly, small pieces for constituting the second absorbing unit were obtained.

The mass ratio of the water-absorbing resin to the fiber substrate was 1.0, and the average particle diameter of the water-absorbing resins was 35 to 50 μm.

Examples 6 to 9

Liquid absorbers were obtained in the same manner as in Example 5, except that the mixing ratio between the first absorbing unit and the second absorbing unit as well as the configuration of the first absorbing unit were changed as illustrated in Table 1.

Comparative Examples 3 and 4

Liquid absorbers were obtained in the same manner as in Example 5, except that the mixing ratio between the first absorbing unit and the second absorbing unit as well as the configuration of the first absorbing unit were changed as illustrated in Table 1.

6. Evaluation of Liquid Absorber 6.1. Evaluation of Liquid Permeation Range

First, 250 cc of an ICBK-61 manufactured by Seiko Epson Corporation as a commercially available ink jet ink was poured from the upper opening of the liquid absorber. The inside of the container was visually observed 2 minutes and 5 minutes after the completion of the pouring. Evaluation was performed according to the following evaluation criteria.

A: Ink spreads in almost the entirety of the inside of the container.

B: Ink spreads in not the entirety but 50% or more of the inside of the container.

C: Ink spreads in 30% or more and less than 50% of the inside of the container.

D: Ink accumulates only near the ink supplying position inside the container.

Table 1 shows the evaluation results.

6.2. Evaluation by Inversion Test

Next, the liquid absorber into which ink had been poured in 6.1. was turned upside down and retained. Then, the amount of ink leaking from the container was measured for 5 minutes. Evaluation was performed according to the following evaluation criteria.

A: The amount of leaked ink is very small.

B: The amount of leaked ink is small.

C: The amount of leaked ink is relatively large.

D: The amount of leaked ink is very large.

Table 1 shows the evaluation results.

TABLE 1

| | Preparation conditions of liquid absorber | | | | | | | |
|---|---|---|---|---|---|---|---|---|
| | Mixing ratio of first absorbing unit — | Mixing ratio of second absorbing unit — | First absorbing unit: Density of blocks alone g/cm$^3$ | First absorbing unit: Bulk density g/cm$^3$ | Second absorbing unit: Mass ratio of absorbing resins — | Evaluation results: Permeation range After 2 min — | Evaluation results: Permeation range After 5 min — | Evaluation results: Inversion test After 5 min — |
| Example 1 | 100 | 0 | 0.08 | 0.50A | — | A | A | C |
| Example 2 | 100 | 0 | 0.16 | 0.60A | — | A | A | B |
| Example 3 | 100 | 0 | 0.32 | 0.75A | — | A | A | B |
| Example 4 | 100 | 0 | 0.44 | 0.75A | — | B | A | B |
| Comparative Example 1 | 100 | 0 | 0.03 | 0.15A | — | D | C | D |
| Comparative Example 2 | 100 | 0 | 0.56 | 0.90A | — | D | C | D |
| Example 5 | 20 | 80 | 0.16 | 0.12A | 1.0 | C | B | A |
| Example 6 | 40 | 60 | 0.16 | 0.25A | 1.0 | B | A | A |
| Example 7 | 50 | 50 | 0.16 | 0.30A | 1.0 | B | A | A |
| Example 8 | 60 | 40 | 0.16 | 0.36A | 1.0 | B | A | A |
| Example 9 | 80 | 20 | 0.16 | 0.48A | 1.0 | A | A | B |
| Comparative Example 3 | 50 | 50 | 0.03 | 0.15A | 1.0 | D | D | C |
| Comparative Example 4 | 50 | 50 | 0.56 | 0.90A | 1.0 | D | D | C |

As is obvious from Table 1, the ink permeated in a sufficiently wide range in Examples in which the density of the porous absorbing body blocks alone that constituted the first absorbing unit was optimized. Also, the porous absorbing body blocks could be uniformly charged in the container. Furthermore, the results of the inversion test demonstrated that the amount of leaked ink was suppressed to a low level.

The same evaluations as above were performed by replacing an ICBK-61 ink jet ink manufactured by Seiko Epson Corporation with a BCI-381sBK ink jet ink manufactured by Canon Inc., an LC3111BK ink jet ink manufactured by Brother Industries, Ltd., or an HP 61XL CH563WA ink jet ink manufactured by Hewlett-Packard Japan, Ltd. As a result, evaluation results similar to the above results were obtained.

What is claimed is:

1. A liquid absorber comprising:

a container that has an opening and that recovers liquid;

a first absorbing unit that is constituted by an aggregate of porous absorbing body blocks and that is housed in the container such that a gap exists between the porous absorbing body blocks; and a second absorbing unit housed in the container so as to be mixed with the first absorbing unit, the second absorbing unit being constituted by an aggregate of small pieces, the small pieces containing a substrate including a fiber, and a polymeric absorbing body supported by the substrate, wherein the porous absorbing body blocks of the first absorbing unit have a density of 0.05 [g/cm$^3$] or more and 0.50 [g/cm$^3$] or less.

2. The liquid absorber according to claim 1, wherein the opening has a shape including a plurality of edges, and a length of the longest edge of each porous absorbing body block is ½ or less of a length of the shortest edge among the plurality of edges of the opening.

3. The liquid absorber according to claim 1, wherein when the porous absorbing body blocks have a density of A [g/cm$^3$], the aggregate has a bulk density of 0.25 A [g/cm$^3$] or more and 1.50 A [g/cm$^3$] or less.

4. The liquid absorber according to claim 1, wherein when a position in which the liquid drops into the container is a drop position, and a position other than the drop position is a non-drop position, a bulk density of the aggregate in the drop position is lower than a bulk density of the aggregate in the non-drop position.

5. The liquid absorber according to claim 1, wherein the first absorbing unit has a mass of 10% or more and 90% or less of a mass of the second absorbing unit.

6. The liquid absorber according to claim 1, wherein when the longest edge of each porous absorbing body block is a first longest edge, and the shortest edge of the porous absorbing body block is a first shortest edge, and the longest edge of each small piece is a second longest edge, and the shortest edge of the small piece is a second shortest edge, the first longest edge and the second longest edge have a length of 5 mm or more and 50 mm or less, and when a ratio of the length of the first longest edge to a length of the first shortest edge is a first aspect ratio, and a ratio of the length of the second longest edge to a length of the second shortest edge is a second aspect ratio, the first aspect ratio and the second aspect ratio are 5 or more.

7. The liquid absorber according to claim 1, wherein when a position in which the liquid drops into the container is a drop position, and a position other than the drop position is a non-drop position, and a ratio of a mass of the polymeric absorbing body to a total mass of the first absorbing unit and the second absorbing unit is a polymer mass ratio, the polymer mass ratio in the drop position is lower than the polymer mass ratio in the non-drop position.

8. An image forming apparatus comprising the liquid absorber according to claim 1.

* * * * *